US007973229B2

(12) United States Patent
Chuang

(10) Patent No.: US 7,973,229 B2
(45) Date of Patent: Jul. 5, 2011

(54) COMB

(75) Inventor: Arthur Chuang, Trossingen (DE)

(73) Assignee: Matth. Hohner AG, Trossingen (DE)

( * ) Notice: Subject to any disclaimer, the term of this patent is extended or adjusted under 35 U.S.C. 154(b) by 0 days.

(21) Appl. No.: 12/723,342

(22) Filed: Mar. 12, 2010

(65) Prior Publication Data

US 2010/0242706 A1 Sep. 30, 2010

(30) Foreign Application Priority Data

Mar. 25, 2009 (DE) ..... 10 2009 014 738

(51) Int. Cl.
*G10D 7/12* (2006.01)

(52) U.S. Cl. ..... 84/377

(58) Field of Classification Search ..... 84/377
See application file for complete search history.

(56) References Cited

U.S. PATENT DOCUMENTS

| | | | | |
|---|---|---|---|---|
| 2,584,572 | A * | 2/1952 | Gaukstern | 84/377 |
| 2,592,220 | A * | 4/1952 | Wetzler | 84/377 |
| 2,595,382 | A * | 5/1952 | Hugin | 84/377 |
| 4,184,404 | A * | 1/1980 | Tomioka | 84/293 |
| 5,739,446 | A * | 4/1998 | Bahnson | 84/377 |
| 6,051,764 | A * | 4/2000 | Sakurai | 84/291 |
| 6,326,532 | B1 * | 12/2001 | Antaki | 84/377 |
| 6,441,285 | B1 * | 8/2002 | Kurosaki | 84/411 R |
| 7,652,206 | B2 * | 1/2010 | Okamoto | 84/411 R |
| 7,847,172 | B2 * | 12/2010 | Harrison | 84/377 |
| 2009/0173209 | A1 * | 7/2009 | Abe et al. | 84/411 R |
| 2010/0199831 | A1 * | 8/2010 | Hiraku et al. | 84/452 R |
| 2010/0242706 | A1 * | 9/2010 | Chuang | 84/377 |

FOREIGN PATENT DOCUMENTS

| | | | |
|---|---|---|---|
| CN | 1122722 | A * | 5/1996 |
| JP | 2008272395 | A * | 11/2008 |
| JP | 2010231204 | A * | 10/2010 |

* cited by examiner

*Primary Examiner* — Elvin G Enad
*Assistant Examiner* — Robert W Horn
(74) *Attorney, Agent, or Firm* — Kilpatrick Townsend & Stockton LLP

(57) ABSTRACT

Comb (1) for a wind instrument, in particular a harmonica, comprising a plurality of cavities (2) forming channels, the comb (1) being constructed from a plurality of thin strips (3) glued together, which extend with a longitudinal dimension (4) along a width (5) of the comb (1) and are cut from bamboo and joined together so that the longitudinal dimension (4) of the thin strips (3) in each case follows the alignment of the grain orientation (6).

7 Claims, 1 Drawing Sheet

COMB

CROSS-REFERENCES TO RELATED APPLICATIONS

This application claims priority from German Application No. 102009014738.1 filed on Mar. 25, 2009, which is incorporated herein by reference.

BACKGROUND OF THE INVENTION

The invention relates to a comb for a wind instrument, in particular a harmonica, according to the preamble of Claim 1.

It is known to make combs from wood for a wind instrument, in particular a harmonica.

The breathing air introduced by an instrument player into the comb, which is intended to cause the vibration of the reeds connected to the comb, contains components consisting of saliva, phlegm or even food residue.

As disclosed in DE 20 2006 008 207 U1, due to the components contained in the breathing air, the comb made of wood may become fragile which, on the one hand, is a problem in terms of hygiene and, on the other hand, may lead to altered behaviour of the harmonica relative to the sound reproduction. It is, therefore, disclosed in DE 20 2006 008 207 U1 to make the comb out of glass. Thus, there is the possibility of cleaning the comb, for example in a dishwasher. In addition to the design of the comb as a separate component made of glass, the comb may also have a layered construction. A drawback, however, is that the musical properties of such a wind instrument are not regarded as satisfactory by the player.

BRIEF SUMMARY OF THE INVENTION

It is, therefore, the object of the present invention to provide a comb for a wind instrument, in particular a harmonica, which improves the playing quality with a satisfactory sound volume.

This object is achieved by the features of Claim 1.

As a result, a comb for a wind instrument, in particular a harmonica, is provided which has a high surface hardness with a high bulk density. The shrinkage behaviour and swelling behaviour of the comb are, as a result, very low. The high surface hardness contributes audibly to a powerful sound volume. According to the invention, the advantages achieved by the bamboo material are associated with a high degree of stability of the comb. According to the invention, the high degree of stability of the comb is achieved by a construction consisting of thin strips glued together, which are cut from bamboo canes and joined together, so that the longitudinal dimension of the thin strips in each case follows the alignment of the grain orientation.

Further embodiments of the invention may be derived from the following description and the sub-claims.

BRIEF DESCRIPTION OF THE DRAWINGS

The invention is described in more detail hereinafter with reference to the exemplary embodiment shown in the accompanying drawing, in which.

DETAILED DESCRIPTION OF THE INVENTION

Figure 1:
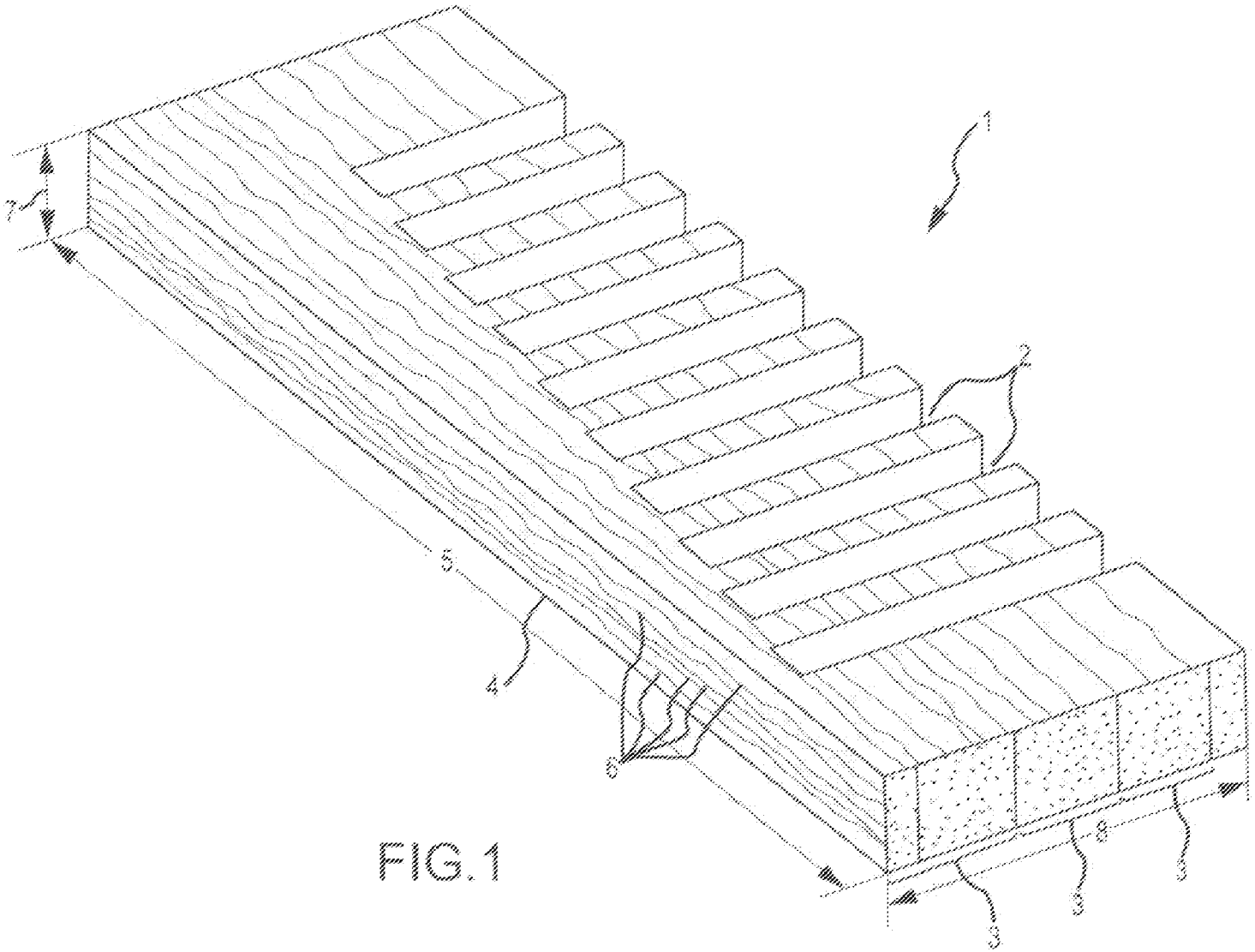
FIG. 1 shows schematically a view of a comb.

The invention relates to a comb 1 for a wind instrument, in particular a harmonica, comprising a plurality of cavities 2 forming channels. The comb 1 has selectable dimensions with a width 5, a depth 7 and a thickness 8 for combs 1 of different sizes.

The comb 1 is constructed from a plurality of thin strips 3 glued together, which extend with a longitudinal dimension 4 along a width 5 of the comb 1 and are cut from bamboo and joined together so that the longitudinal dimension 4 of the thin strips 3 in each case follows the alignment of the grain orientation 6. The structural design of the comb 1 as a unit consisting of bamboo rods is visible in FIG. 1. According to the invention, an extremely high degree of stability results from the selected grain orientation in the thin strips 3. According to the invention, it has been further established that from an audio-technical perspective, the selected grain orientation produces a more powerful sound volume.

The thin strips 3 are preferably configured in the shape of rods. Further preferably, the thin strips 3 have in each case a longitudinal dimension 4 which is adapted to the width 5 of the comb 1. To this end, the thin strips 3 are sawn from the bamboo cane and subsequently planed flat. During planing, the green outer bark is removed so that only the pale interior of the bamboo cane is used for the thin strips.

The thin strips 3 are preferably joined together, superimposed in layers to form a comb 1. Preferably, the thin strips 3 are additionally glued together horizontally. It is further preferred that the thin strips 3 are glued together by a press fit.

The depth 7 of the comb 1 is preferably constructed from more than three layers of thin strips 3; preferably four to six layers are provided.

The comb 1 is preferably sealed with a lacquer. A two-component lacquer, for example, may be used as a lacquer.

The invention has now been described in detail for purposes of clarity of understanding. However, it will be appreciated that certain changes and modifications may be practiced within the scope of the appended claims.

What is claimed is:

1. Comb for a harmonica, comprising a plurality of cavities forming channels, wherein the comb is constructed from a plurality of thin strips glued together, which extend with a longitudinal dimension along a width of the comb and are cut from bamboo and joined together so that the longitudinal dimension of the thin strips in each case follows the alignment of the grain orientation.

2. Comb according to claim 1, characterized in that the longitudinal dimension of the thin strips is adapted to the width of the comb.

3. Comb according to claim 1, characterized in that the thin strips are superimposed in layers.

4. Comb according to claim 3, characterized in that the comb has a depth which consists of four to six layers of thin strips.

5. Comb according to claim 1, characterized in that the thin strips are glued together horizontally.

6. Comb according to claim 5, characterized in that the thin strips are glued together by a press fit.

7. Comb according to claim 1, characterized in that the comb is sealed with a lacquer.

* * * * *